US007012360B2

(12) United States Patent
Iwasaki et al.

(10) Patent No.: US 7,012,360 B2
(45) Date of Patent: Mar. 14, 2006

(54) CATHODE RAY TUBE APPARATUS HAVING VELOCITY MODULATION COIL

(75) Inventors: Katsuyo Iwasaki, Nishinomiya (JP); Kenichiro Taniwa, Takatsuki (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 29 days.

(21) Appl. No.: 10/802,090

(22) Filed: Mar. 16, 2004

(65) Prior Publication Data

US 2004/0251835 A1 Dec. 16, 2004

(30) Foreign Application Priority Data

Mar. 20, 2003 (JP) ..... 2003-078690

(51) Int. Cl.
*H01J 29/70* (2006.01)

(52) U.S. Cl. ..... 313/477 R; 315/8; 355/210; 313/422; 313/440

(58) Field of Classification Search ..... 313/440, 313/477, 422; 335/210; 315/399
See application file for complete search history.

(56) References Cited

U.S. PATENT DOCUMENTS 3,710,438 A * 1/1973 Max et al. ..... 29/603.08
4,621,215 A * 11/1986 Tanaka ..... 313/422
5,028,898 A * 7/1991 Tsukii et al. ..... 335/210
5,223,769 A * 6/1993 Priere et al. ..... 315/370
6,046,538 A * 4/2000 Hishiki et al. ..... 313/440
6,448,706 B1 * 9/2002 Kawamura et al. ..... 313/477 R
6,455,997 B1 * 9/2002 Lee ..... 313/440
6,750,602 B1 * 6/2004 Hirota et al. ..... 313/477 R

FOREIGN PATENT DOCUMENTS

JP 57-045650 3/1982
JP 06-283113 10/1994

* cited by examiner

*Primary Examiner*—Binh V Ho

(57) ABSTRACT

A CRT apparatus is composed of a CRT, a deflection yoke, a velocity modulation coil, and a magnetic member. The CRT includes a glass bulb made up of a panel and a funnel connected together and an electron gun housed within the glass bulb, and emits an electron beam from the electron gun toward a phosphor screen formed on an inner surface of the panel. The deflection yoke includes a horizontal deflection coil and a vertical deflection coil, and scans the electron beam over the phosphor screen. The velocity modulation coil is arranged outside the CRT, and modulates a velocity at which the electron beam is scanned horizontally. The magnetic member is arranged to surround an outer circumference of the CRT with the velocity modulation coil positioned therebetween, so as to cover a position corresponding to a space between axially aligned electrodes of the electron gun.

12 Claims, 8 Drawing Sheets

(a)

(b)

(c)

CATHODE RAY TUBE APPARATUS HAVING VELOCITY MODULATION COIL

This application is based on application No. 2003-78690 filed in Japan, the contents of which are hereby incorporated by reference.

BACKGROUND OF THE INVENTION (1) Field of the Invention

The present invention relates to a cathode ray tube (CRT) apparatus for use in television sets and computer displays. More particularly, the present invention relates to a CRT apparatus having a velocity modulation coil.

(2) Description of the Related Art

Edge enhancement is one scheme for realizing high image quality on television. To carry out edge enhancement processing, a television set is provided with a velocity modulation coil arranged at or near a neck portion of a CRT. The velocity modulation coil generates a magnetic field in a vertical direction to modulate the horizontal scanning velocity of an electron beam, thereby emphasizing the appearance of edges in images (See, for example, Examined Japanese Utility Model Application Publication No. S57-45650).

With the recent trend toward color CRT apparatuses having a larger screen, higher luminance, and a flat front panel, the spot diameter of an electron beam on a phosphor screen is larger and the anode voltage is higher. Such color CRT apparatuses require a stronger magnetic field for performing edge enhancement.

To meet the above need, there is suggested a color CRT apparatus capable of increasing the magnetic field that affects the electron beam, without increasing the amount of electric current flowing through the velocity modulation coil or the number of turns of the velocity modulation coil (See, for example, Unexamined Japanese Patent Application Publication No. 06-283113).

In a color CRT apparatus disclosed in the 06-283113 publication, a fifth grid (G5 electrode) of an electron gun that is housed within a neck portion of a CRT has holes for respective electron beams R, G, and B to pass through, and a magnetic member is arranged above and under the holes. In addition, a velocity modulation coil is arranged along an outer circumference of the neck portion at a position corresponding to the G5 electrode. With this structure, magnetic flux generated by the velocity modulation coil is concentrated by the action of the magnetic member to an area through which the electron beams pass. This leads to improve the strength of the magnetic field which contributes to scanning velocity modulation of electron beams.

However, the color CRT apparatus of the 06-283113 publication is insufficient to achieve enough effect. With the disclosed structure, the magnetic field generated inside the G5 electrode (the electron beam passing area) is inevitably weak due to the eddy current loss occurred in the electrode (G5 electrode) made of metal. The magnetic member does strengthen this weak magnetic field but not to a sufficient level. That is to say, the color CRT apparatus disclosed in the 06-283113 publication fails to improve the velocity modulation sensitivity (the amount of modulation in the electron beam velocity relative to input current to the velocity modulation coil) as much as desired. Furthermore, there is another problem. The magnetic member and the G5 electrode are connected together by welding. Naturally, welding of such small components requires a number of manufacturing steps and high manufacturing cost.

SUMMARY OF THE INVENTION

In view of the above problems, an object of the present invention is to provide a CRT apparatus that is simple in structure and effectively improves the velocity modulation sensitivity.

The object stated above is achieved by a cathode ray tube apparatus composed of a cathode ray tube, a deflection yoke, a velocity modulation coil, and a magnetic member. The cathode ray tube includes a glass bulb formed from a panel and a funnel connected together and an electron gun housed within the glass bulb, and is operable to emit an electron beam from the electron gun toward a phosphor screen formed on an inner surface of the panel. The deflection yoke includes a horizontal deflection coil and a vertical deflection coil, and is operable to scan the electron beam horizontally and vertically over the phosphor screen. The velocity modulation coil is arranged outside the cathode ray tube, and operable to modulate a velocity at which the electron beam is scanned horizontally. The magnetic member is arranged to surround an outer circumference of the cathode ray tube with the velocity modulation coil positioned therebetween, so as to cover a position corresponding to a space between a first electrode and a second electrode of the electron gun that are aligned in an axial direction.

With the structure stated above, by the action of the magnet member that surrounds an outer circumference of the cathode ray tube in a manner to cover a position corresponding to a space between the first and second electrodes of the electron gun with the velocity modulation coil positioned therebetween, the magnetic flux generated by the velocity modulation coil concentrates to the electron beam passing area in the space. Consequently, the velocity modulation sensitivity improves.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a preferred embodiment of the present invention, with reference to the drawings.

Figure 1:
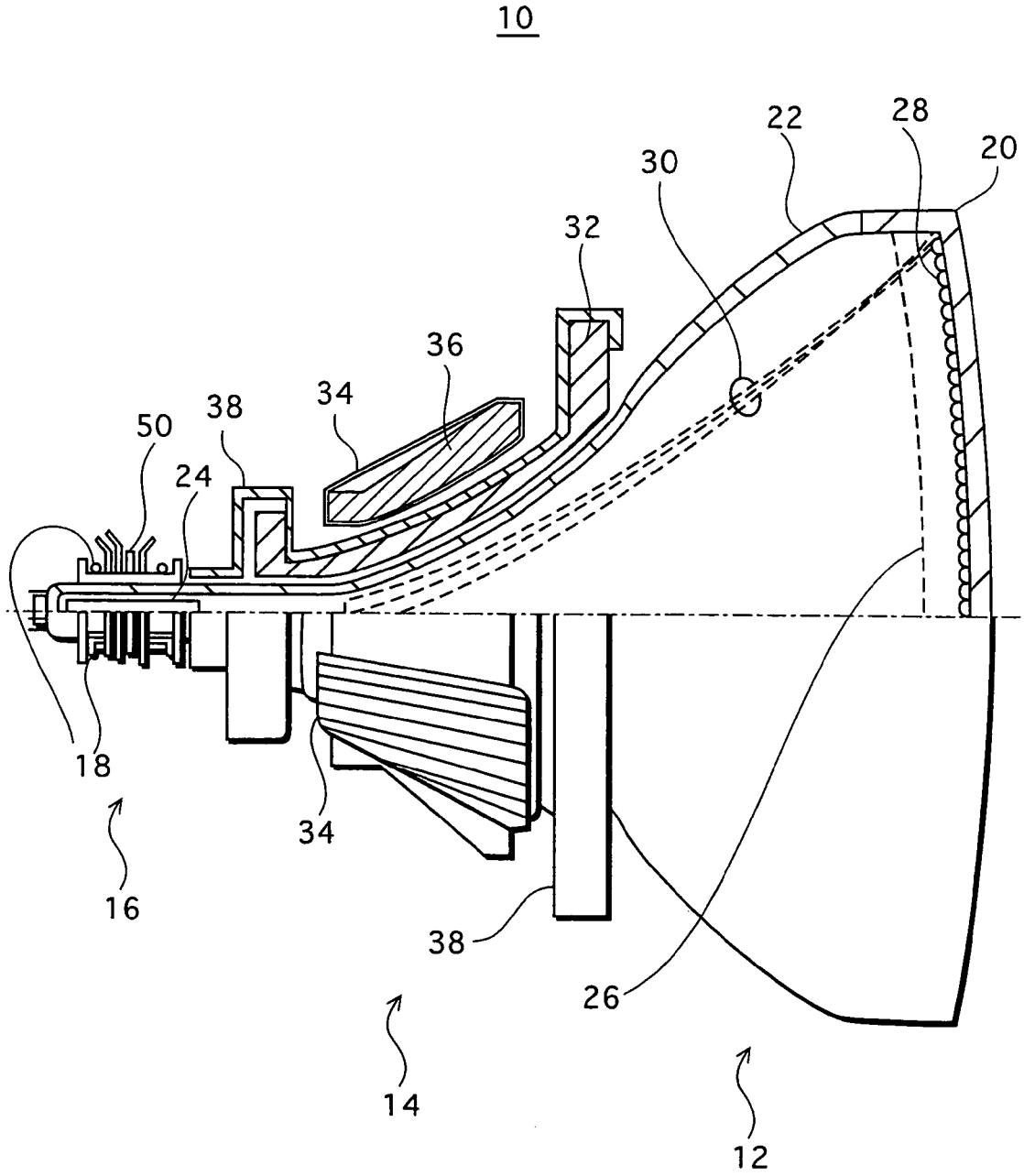
FIG. 1 is a half cross-sectional view showing a schematic structure of a color CRT apparatus of an embodiment of the present invention.

FIG. 1 is a half cross-sectional view showing a schematic structure of a color CRT apparatus 10.

As shown in FIG. 1, the color CRT apparatus 10 is mainly composed of a color CRT 12, a deflection yoke 14, a CPU (Convergence and Purity Unit) 16, and a velocity modulation coil 18.

The color CRT 12 is composed of a face panel 20 and a funnel 22 that are connected together to constitute a glass bulb. The glass bulb houses an inline-type electron gun (hereinafter, simply referred to as an "electron gun") 24, a shadow mask 26, and so on.

On the inner surface the face pane 120 is a phosphor screen 28 formed with dots of red, green, and blue phosphors that are arranged in a regular order. The shadow mask 26 and the phosphor screen 28 are arranged substantially in parallel. The shadow masks 26 is provided with a number of beam passing holes, so that three electron beams 30 emitted from the electron gun 24 correctly hit phosphors of the respective colors.

The deflection yoke 14 is provided along the outer circumference of the funnel 22, and deflects the three electron beams 30 in vertical and horizontal directions so as to scan the electron beams 30 over the surface of the phosphor screen 28 by raster scanning. The deflection yoke 14 includes a saddle-shaped horizontal deflection coil 32 and a toroidal-shaped vertical deflection coil 34. The vertical deflection coil 34 is wound around the ferrite core 36. A resin frame 38 is provided between the vertical deflection coil 34 and the horizontal deflection coil 32. The resin frame 38 electrically insulates the deflection coils 32 and 34 from each other, as well as physically supporting the deflection coils 32 and 34.

Figure 2:
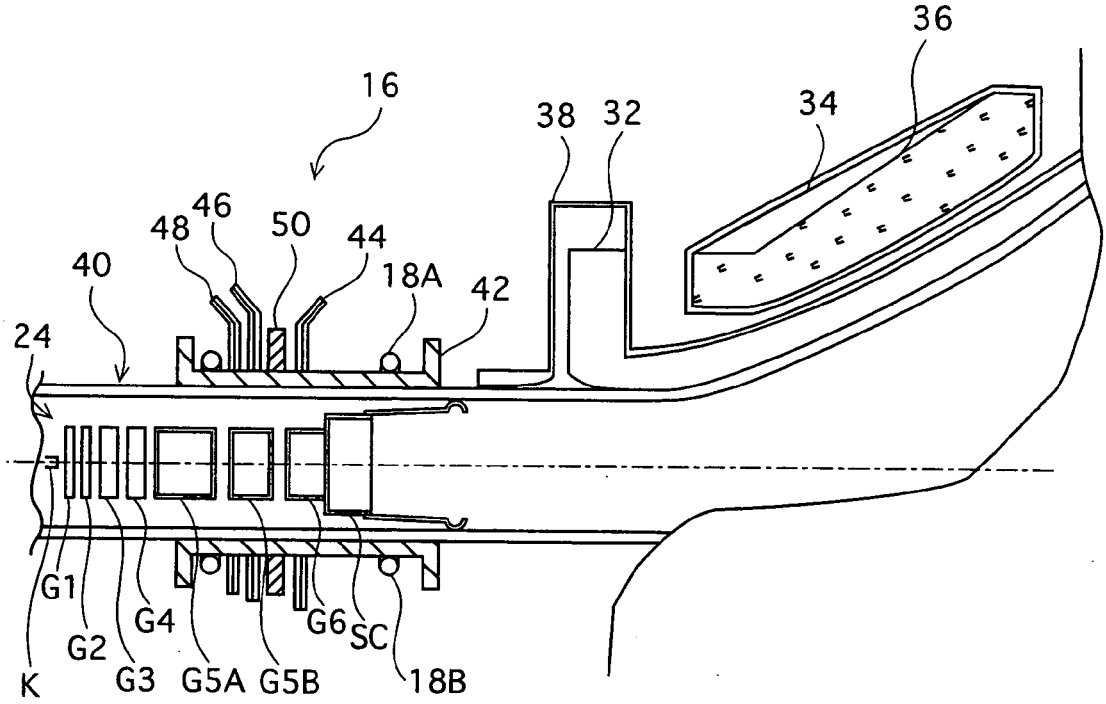
FIG. 2 is an enlarged view showing a neck portion and a nearby portion of the CRT apparatus.

FIG. 2 is an enlarged view showing a cylindrical neck portion 40 and a nearby portion of the funnel 22.

The electron gun 24 is housed within the neck portion 40. The electron gun 24 is mainly composed of: three cathodes K each of which are separately heated by three respective heaters (not shown); electrodes G1, G2, G3, G4, G5A, G5B, and G6 which are arranged in the stated order from the cathodes K toward the phosphor screen 28 along the tube axis direction at predetermined space intervals; and a shield cup SC attached to the electrode G6. (Note that since the cathodes K are aligned, only one of the cathodes K located in the front is shown in the figure.) The electron gun 24 forms a main lens between the electrodes G5B and G6, and the main lens converges each of the electron beams onto the phosphor screen 28.

The CPU 16 is arranged along the outer circumference of the neck portion 40 at a position corresponding to the electron gun 24, and for adjustment of the static convergence and color purity of the electron beams. Specifically speaking, the CPU 16 is composed of a cylindrical resin frame 42 to which a purity (color) purity magnet 44, a four-pole magnet 46, and a six-pole magnet 48 are attached. Each of the purity magnet 44, the four-pole magnet 46, and the six-pole magnet 48 are made up of a pair of annular-shaped magnets.

The velocity modulation coil 18 is made up of a pair of loop coils (hereinafter, simply referred to as "coils") 18A and 18B. The coils 18A and 18B are attached to the resin frame 42 that constitutes the CPU 16. That is to say, the velocity modulation coil 18 is integrally attached to the CPU 16.

Figure 3A:
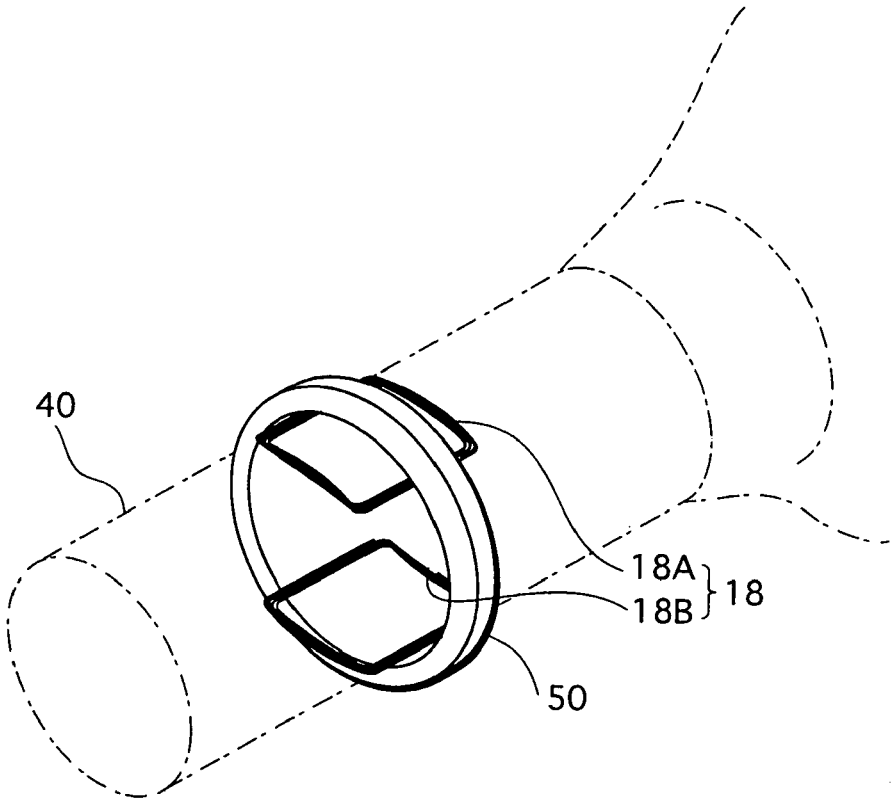
FIG. 3A is an oblique view showing a velocity modulation coil and a magnetic ring.
Figure 3B:
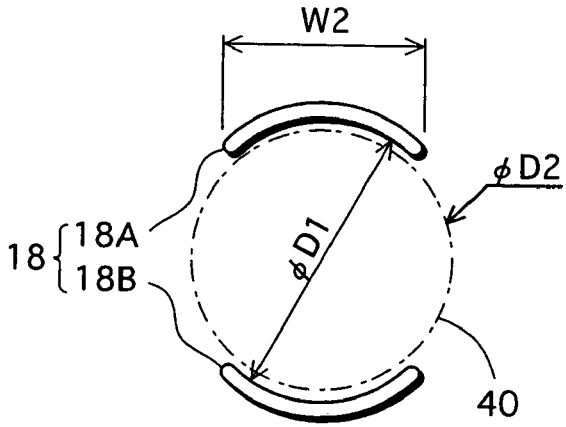
FIG. 3B is a schematic cross-sectional view of the velocity modulation coil taken along a plane perpendicular to a tube axis.
Figure 3C:
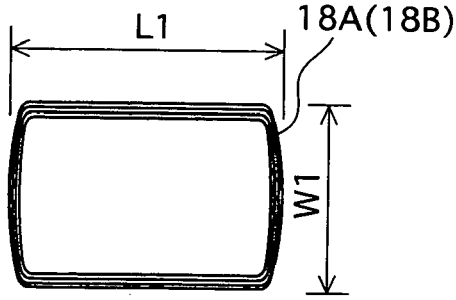
FIG. 3C is a top view of the velocity modulation coil.

FIG. 3A is a schematic oblique view showing the velocity modulation coil 18, FIG. 3B is a schematic sectional view of the velocity modulation coil 18, taken along a plane perpendicular to the tube axis, and FIG. 3C is a top view of the velocity modulation coil 18.

Each of the coils 18A and 18B is made with a polyurethane-coated, 0.4 mm diameter copper wire that is wound four times in a substantially rectangular shape. As shown in FIG. 3, the coils 18A and 18B are arranged in opposed relation so as to sandwich the neck portion 40 from above and under. Furthermore, each of the coils 18A and 18B conforms to the shape of the outer circumference of the neck portion 40 (i.e. has a shape that is substantially identical with the outer circumference of the neck portion 40). Each of the coils 18A and 18B has a length L1=25 [mm], and a developed width W1= 35 [mm]. When attached to the resin frame 42 in a manner to conform to the shape of an imaginary cylinder having a diameter Dϕ=36 [mm], each of the coils 18A and 18B has a width W2 of about 30 [mm].

The velocity modulation coil 18 is supplied with an electric current according to a velocity modulation signal gained by differentiating an image signal.

In addition, an annular-shaped magnetic ring 50 is inserted over the color CRT 12 (neck portion 40) so that the velocity modulation coil 18 is placed between the inner surface of the magnetic ring 50 and the outer surface of the color CRT 12. The magnetic ring 50 is a sinter body of Ni—Zn ferrite magnetic powder, and has a specific resistance value of $1\times10^4$ [Ω·m]. The magnetic ring 50 is substantially rectangular in transverse cross-section, and has an inside diameter of 38 [mm], an outside diameter of 44 [mm], and a thickness of 4 [mm]. Note that the magnetic ring 50 is attached to the resin frame 42 at a position corresponding in the axial direction to the space between the G5B and G6 electrodes. That is to say, the magnetic ring 50 is arranged to circumferentially surround the color CRT 12 in a manner to cover a position corresponding to the space between the G5B and G6 electrodes.

By providing the magnetic ring 50 as above, it is made possible to increases the density of magnetic flux which affects electron beams 30 within the neck portion 40.

This mechanism is explained with reference to FIGS. 4 and 5. FIGS. 4A and 4B schematically illustrate magnetic flux generated in the case where the magnetic ring 50 is not provided, and where the magnetic ring 50 is provided, respectively. Note that both the FIGS. 4A and 4B are show cross-sections of the of the neck portion 40 taken at a position of the velocity modulation coil 18 along a plane perpendicular to the tube axis.

Figure 4A:
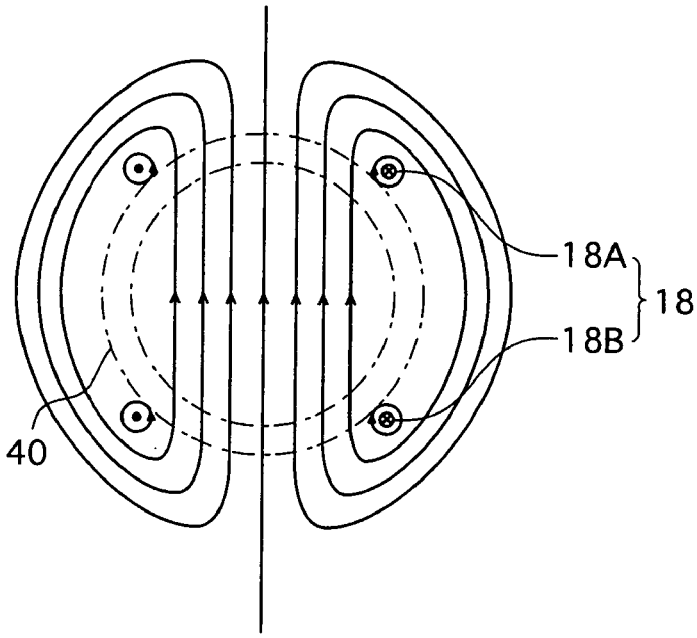
FIG. 4A is a schematic representation of magnetic flux generated by a velocity modulation coil not provided with the magnetic ring of the embodiment.
Figure 4B:
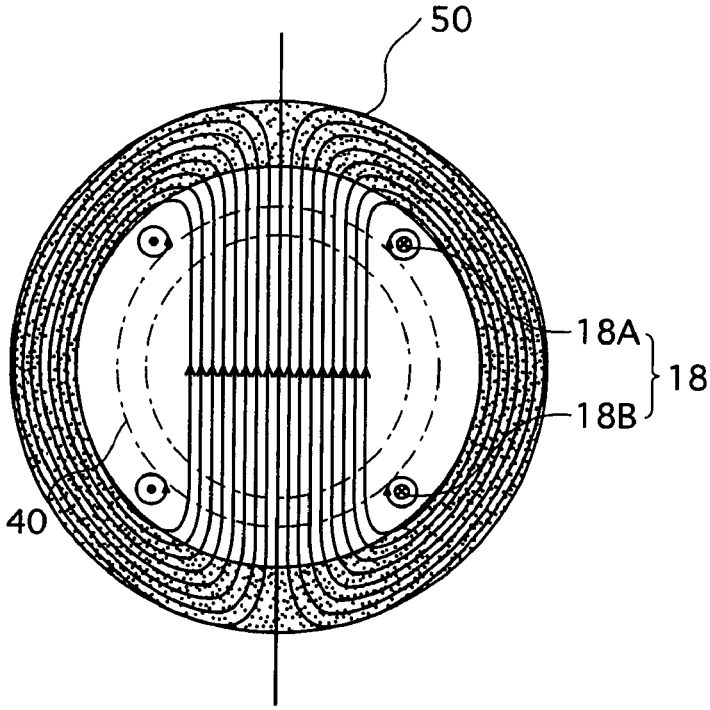
FIG. 4B is a schematic representation of magnetic flux generated by the velocity modulation coil provided with the magnetic ring of the embodiment.

As apparent from the FIGS. 4A and 4B, the magnetic ring 50 causes magnetic flux to concentrate inside the magnetic ring 50 (the area of the neck portion 40 where the electron beams pass through) owing to a so-called "core effect". As a result, the density of magnetic flux which affects the electron beams increases.

Moreover, since the magnetic ring 50 is arranged at a position corresponding to the space between the electrodes (the G5B electrode and the G6 electrode) constituting the electron gun 24, influence of the eddy current loss in the electrodes is minimized as much as possible. In addition, the above arrangement also serves to extend the magnetic field. Consequently, the velocity modulation sensitivity can be effectively improved.

Figure 5:
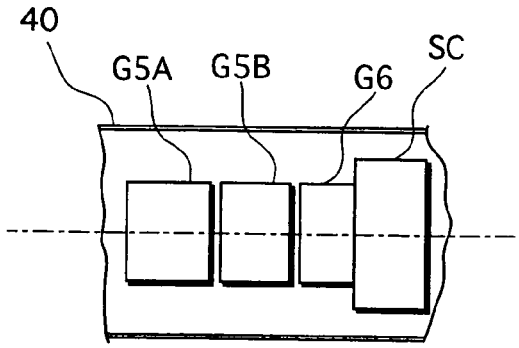
FIG. 5 is a schematic representation of magnetic flux densities along the tube axis, (a) relates to the CRT not provided with the magnetic ring of the embodiment, and (b) relates to the CRT provided with the magnetic ring of the embodiment.
Figure 5:
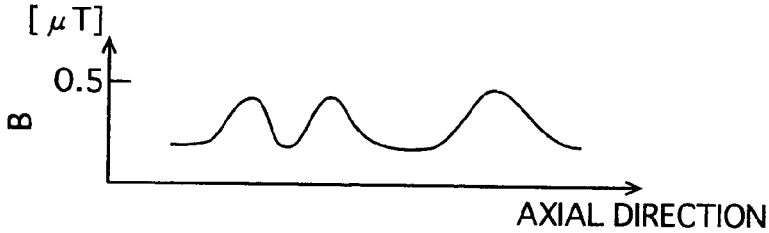
Figure 5:
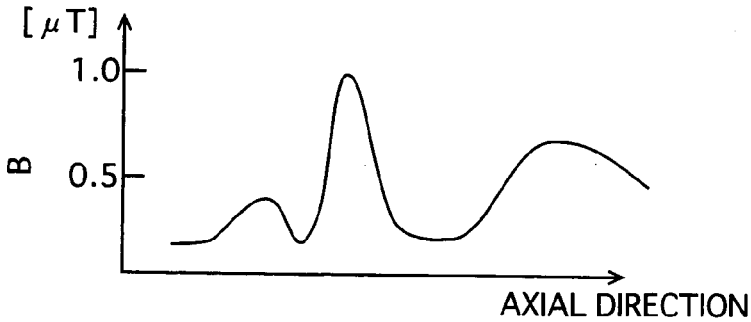

FIG. 5 is a view showing changes in magnetic field density measured along the tube axis from the vicinity of the electrode G5A to the vicinity of the shield cup SC (measured at positions corresponding to (a)). In the figure, (b) shows the measurements in the case where the magnetic ring 50 was not provided, while (c) shows the measurements in the case where the magnetic ring 50 was provided.

As seen from (b) in FIG. 5, in the area along the tube axis where an electrode is present, the magnetic flux density is lower than that in the area where no electrode is present. This is ascribable to the eddy current loss occurred in the electrode. Conventionally, an attempt is made to increase this low magnetic flux density, so that the velocity modulation sensitivity does not improve as much as desired.

As seen from (c) in FIG. 5, by the presence of the magnetic ring 50, the magnetic flux density at the space between the G5B and G6 electrodes approximately doubles. It is also apparent that the magnetic field extends toward the screen side of the electron gun. Consequently, the velocity modulation sensitivity improves to a greater extent than conventionally achieved.

Figure 6:
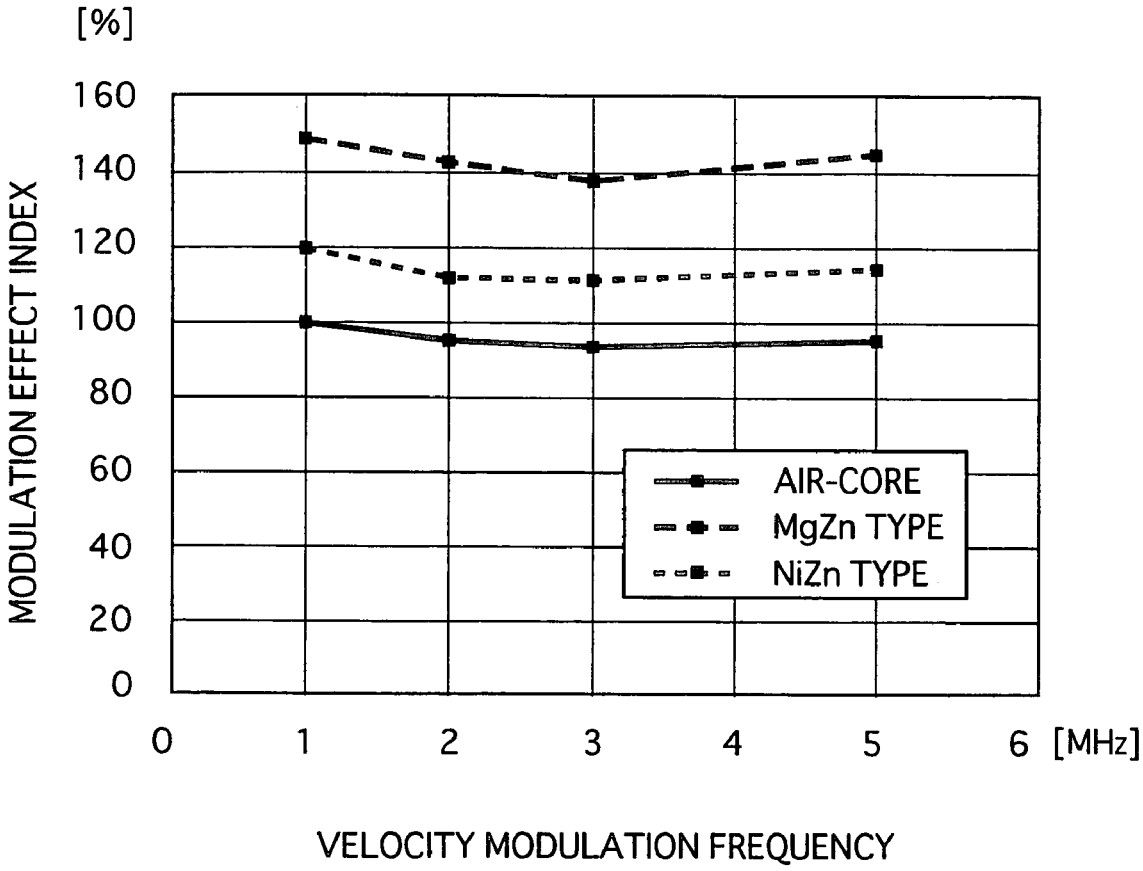
FIG. 6 is a graph of indices of velocity modulation effects exhibited at different velocity modulation frequencies by respective CRTs provided with one of an air-core, a magnetic ring of sintered MgZn ferrite, a magnetic ring of sintered NiZn ferrite.

FIG. 6 is a graph showing the result of comparison test on the velocity modulation sensitivity. The comparisons were made on the three types of CRTs: one provided with an air-core (i.e. no magnetic ring), another provided with a magnetic ring of sintered MgZn ferrite, and the other provided with a magnetic ring of sintered NiZn ferrite.

In FIG. 6, the horizontal axis of the graph represents the frequency of velocity modulation signal (hereinafter, referred to as a "velocity modulation frequency").

The vertical axis of the graph represents horizontal displacements of the spot diameter from the center of the phosphor screen (hereinafter, referred to as "beam displacement"). The beam displacements are relatively expressed as a percentage. That is to say, the beam displacement observed with the CRT provided with an air-core at the velocity modulation frequency of 1 MHz is taken as 100%. Further, the measurements were obtained based on the spot diameter defined by cutting a part of the spot of which luminance fell in the lowest 5% when the luminance at its peak was taken as 100%. Note that the current supplied to each velocity modulation coil in this test was constant at 0.8 [A].

As shown in FIG. 6, with the velocity modulation frequency in the range of 1–5 MHz, the MgZn type CRT exhibits the velocity modulation effect which is 1.5 times better than that of the air-core type CRT, and the NiZn type CRT exhibits the velocity modulation effect which is 1.2 times better than that of the air-core type CRT.

As described above, the CRT apparatus according to the present embodiment is provided with a magnetic ring arranged to surround the outer circumference of the CRT so as to cover a position corresponding to a space between two adjacent electrodes (the G5B and G6 electrodes) of the electron gun. Here, the velocity modulation coil is placed between the outer surface of the CRT and the inner surface of the magnetic ring. With this structure, the magnetic flux generated by the velocity modulation coil is made to concentrate to the space, which effectively increases the magnetic density within the electron beam passing area. Consequently, the velocity modulation sensitivity improves.

As apparent from FIG. 5B, even if no magnetic ring is provided, the magnetic flux is dense at spaces where no electrode is located as compared with an area where an electrode is located. In view of the above, there is a conventional scheme to constitute an electron gun with a greater number of electrodes only for increasing the number of spaces. With this structure, more magnetic flux is generated at more locations throughout the electron beam passing area. Unfortunately, however, this scheme increases the number of components as well as the manufacturing steps, which inevitably requires increase in the cost of electron gun. On the contrary, the present embodiment effectively increases the density of the magnetic flux present in the electron beam passing area, without employing the conventional scheme.

Up to this point, the present invention has been described by way of one preferred embodiment. However, it is naturally appreciated that the present invention is not limited to the above specific embodiment and various modifications including the followings may be made.

(1) In the above embodiment, the velocity modulation coil and the magnetic ring are integrally attached to the CPU. In other words, the velocity modulation coil and the magnetic ring are both attached to the resin frame of the CPU. However, the velocity modulation coil and the magnetic ring may be integrally attached to the deflection yoke.

Figure 7:
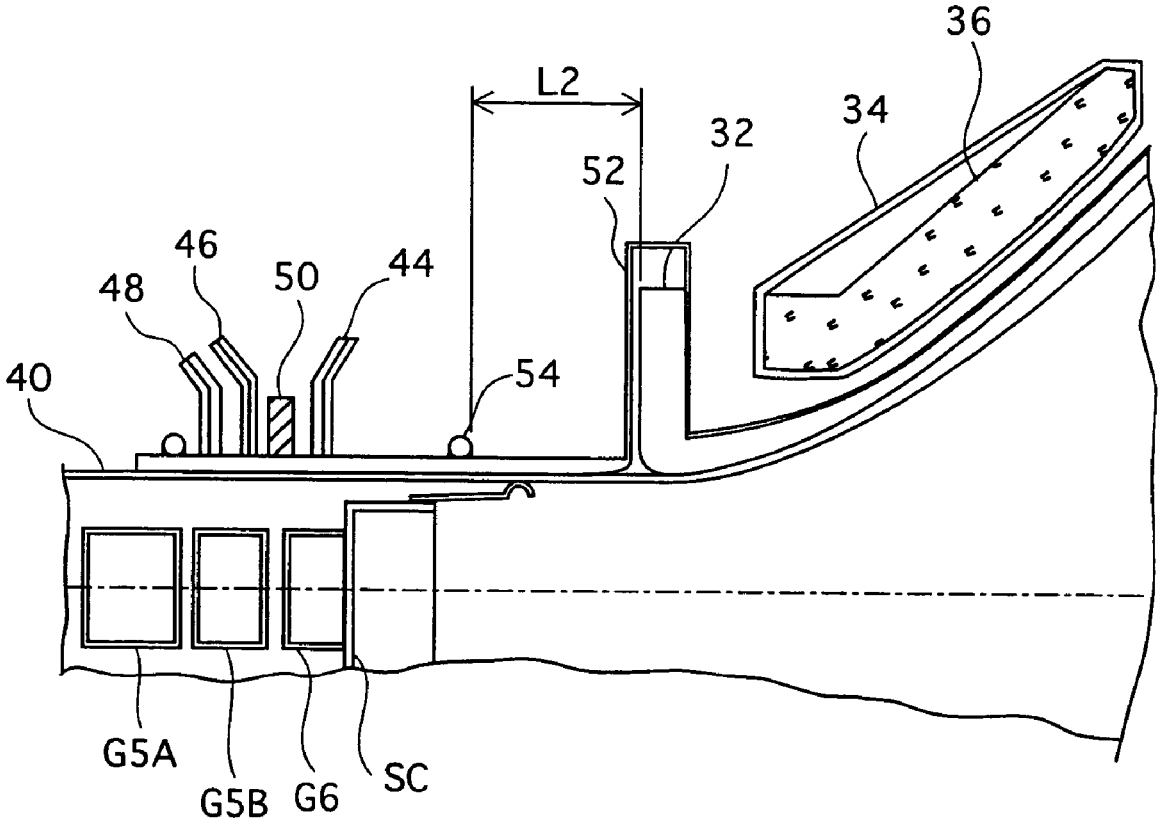
FIG. 7 is an enlarged view of a neck portion and a nearby portion of a CRT apparatus according to a modification of the present invention.
Figure 8:
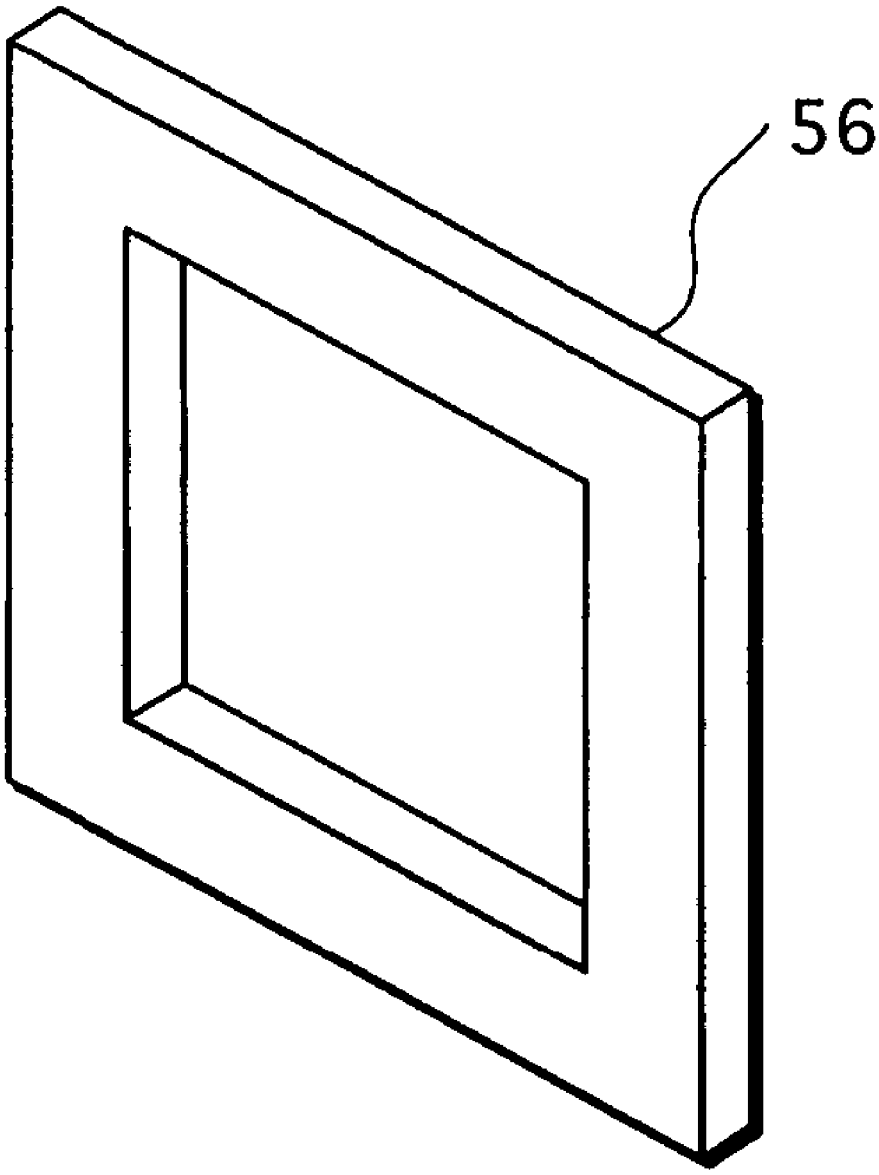
FIG. 8 a view showing a magnetic ring according to a modification of the present invention.

FIG. 7 shows one example of such a structure.

As shown in FIG. 7, a resin frame 52 insulates the horizontal deflection coil 32 and the vertical deflection coil 34 of the deflection yoke. In addition, the resin frame 52 supports the two deflection coils 32 and 34. Different from the resin frame 38, the resin frame 52 in this example extends to the neck portion 40, and a velocity modulation coil 54 and the magnetic ring 50 are attached to the extended portion of the resin frame 52. That is to say, in the example shown in FIG. 7, the velocity modulation coil 54 and the magnetic ring 50 are integrally attached to the deflection yoke.

In addition, in this example, the purity magnet 44, the four-pole magnet 46, and the six-pole magnet 48 are also attached to the resin frame 52. In other words, the CPU and the deflection yoke are integrally formed.

(2) In the example shown in FIG. 7, the velocity modulation coil 54 extends toward the horizontal deflection coil 32 when compared with the example shown in FIG. 2. This structure achieves the following effect. That is, since the velocity modulation coil is arranged partly beyond the phosphor screen side of the shield cup SC, no metallic components (electrode and shield cup) are located in the beam passing area corresponding to this part of the velocity modulation coil. The magnetic flux generated in this beam passing area by the velocity modulation coil helps to improve the velocity modulation sensitivity.

However, care should be taken so as not to excessively extend the velocity modulation coil, i.e. not to make the velocity modulation coil too close to the horizontal deflection coil. When the two coils are too close to each other, it is likely that the magnetic field generated by the velocity modulation coil interferes excessively with the magnetic field generated by the horizontal deflection yoke. The interference of the magnetic fields causes so-called "ringing" to appear in images formed on the phosphor screen.

In this example, it has been confirmed that ringing to a non-negligible extent is prevented as long as a distance L2 between the phosphor screen side of the velocity modulation coil and the electron gun side of the horizontal deflection coil is set to be 8 [mm] or longer.

(3) In the above embodiment, the magnetic ring is located so as to cover a position corresponding to the space between the G5 and G6 electrodes. This is because a main lens for converging the electron beams onto the phosphor screen is formed between theses two electrodes. In general (as well as in the above embodiment), the space between the electrodes forming the main lens is wider than any other spaces between other electrodes.

However, the magnetic ring is not necessarily provided at a position corresponding to the space between the above noted electrodes, and may be provided at a position corresponding to any other space. As long as it is located to cover a position corresponding to a space between two adjacent electrodes, the magnetic ring serves to increase the magnetic flux density in the electron beam passing area.

Furthermore, more than one magnetic ring may be provided, so that a magnetic ring may be provided at every position corresponding to a space between two adjacent electrodes. This arrangement further increase the magnetic flux density throughout the entire electron beam passing area, and thus further improves the velocity modulation sensitivity.

(4) In the above embodiment, the magnetic ring has an annular shape. However, the magnetic ring may have other looped shapes including a shape of a square frame as shown in FIG. 7 or a shape of a polygonal frame with five or more sides. In this case, it is preferable that the magnetic ring have a shape of a regular polygonal frame for ensuring the symmetry in the magnetic flux generated within the neck portion.

Furthermore, in the above embodiment, the magnetic ring has a completely-closed annular shape. However, the magnetic ring may have a shape that is partly-broken away or opened, such as C-shape, or may be broken away at more than two locations. As long as the magnetic ring has a shape to circumferentially surround the CRT (neck portion) in a manner to cover a position corresponding to the space between electrodes, the above-stated effect is duly achieved.

(5) In the above embodiment, the magnetic ring is made of sintered Ni—Zn ferrite. However, the magnetic ring may be made of sintered Mg—Zn ferrite, instead.

Still further, the magnetic ring is not limited to a sintered body, and may be made of a resin mixed with a power of any of the above ferrites. With this arrangement, the manufacturing cost is reduced when compared to the magnetic ring made by sintering.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cathode ray tube apparatus comprising:

a cathode ray tube that includes a glass bulb formed from a panel and a funnel connected together and an electron gun housed within the glass bulb, and is operable to emit an electron beam from the electron gun toward a phosphor screen formed on an inner surface of the panel;

a deflection yoke including a horizontal deflection coil and a vertical deflection coil, and operable to scan the electron beam horizontally and vertically over the phosphor screen;

a velocity modulation coil arranged outside the cathode ray tube, and operable to modulate a velocity at which the electron beam is scanned horizontally; and a magnetic member arranged to surround an outer circumference of the cathode ray tube with the velocity modulation coil positioned, between the outer circumference of the cathode ray tube and an inner surface of the magnetic member, the magnetic member covers a space between a first electrode and a second electrode of the electron gun that are aligned in an axial direction.

2. The cathode ray tube apparatus according to claim 1, wherein the magnetic member has a looped shape and is inserted over the cathode ray tube.

3. The cathode ray tube apparatus according to claim 1, wherein the first and second electrodes generate a main lens for converging the electron beam onto the phosphor screen.

4. The cathode ray tube apparatus according to claim 1, wherein the velocity modulation coil is spaced apart from the horizontal deflection coil in the axial direction, so as to avoid occurrence of ringing in an image formed on the phosphor screen caused by interference between magnetic fields generated by the velocity modulation coil and by the horizontal deflection coil.

5. The cathode ray tube apparatus according to claim 2, wherein the magnetic member is made of sintered Ni—Zn ferrite.

6. The cathode ray tube apparatus according to claim 2, wherein the magnetic member is made of resin mixed with Ni—Zn ferrite magnetic powder.

7. A cathode ray tube apparatus comprising:

a cathode ray tube having a panel and a funnel connected together and an electron gun operable to emit an electron beam from the electron gun toward a phosphor screen formed on an inner surface of the panel;

a deflection yoke including a horizontal deflection coil and a vertical deflection coil, and operable to scan the electron beam horizontally and vertically over the phosphor screen;

a velocity modulation coil arranged exterior to the cathode ray tube, and operable to modulate a velocity at which the electron beam is scanned horizontally; and a magnetic member arranged to surround an outer circumference of the cathode ray tube, with the velocity modulation coil positioned radially from an axis of the electron gun, between the outer circumference of the cathode ray and an inner surface of the magnetic member, to increase magnetic flux density in the passage of the electron beam.

8. The cathode ray tube apparatus according to claim 7, wherein the magnetic member has a looped shape and is inserted over the cathode ray tube.

9. The cathode ray tube apparatus according to claim 7, wherein the magnetic member is made of sintered Ni—Zn ferrite.

10. The cathode ray tube apparatus according to claim 7, wherein the magnetic member is made of resin mixed with Ni—Zn ferrite magnetic powder.

11. The cathode ray tube apparatus according to claim 7, wherein first and second electrodes function to provide a main lens for converging the electron beam onto the phosphor screen.

12. The cathode ray tube apparatus according to claim 7, wherein the velocity modulation coil is spaced apart from the horizontal deflection coil in an axial direction, so as to avoid occurrence of ringing in an image formed on the phosphor screen caused by interference between magnetic fields generated by the velocity modulation coil and by the horizontal deflection coil.

* * * * *